United States Patent [19]

Ahrens

[11] 4,286,937

[45] Sep. 1, 1981

[54] PRODUCTION OF SAND MOULDS

[75] Inventor: Walter Ahrens, Alfeld, Fed. Rep. of Germany

[73] Assignee: Alfelder Maschinen- und Modell-Fabrik Kunkel, Wagner & Co. KG, Fed. Rep. of Germany

[21] Appl. No.: 80,171

[22] Filed: Oct. 1, 1979

[30] Foreign Application Priority Data

Oct. 2, 1978 [DE] Fed. Rep. of Germany ..... 2842912

[51] Int. Cl.[3] ..... B28B 13/02

[52] U.S. Cl. ..... 425/125; 425/127; 425/177; 425/405 R; 425/546

[58] Field of Search ..... 425/125, 127, 175, 177, 425/405 R, 546

[56] References Cited

U.S. PATENT DOCUMENTS

| | | | |
|---|---|---|---|
| 2,904,861 | 9/1959 | Morgenstern | 425/546 |
| 2,975,476 | 3/1961 | Burke | 425/177 |
| 3,328,852 | 7/1967 | Ellms | 425/177 |

FOREIGN PATENT DOCUMENTS

| | | |
|---|---|---|
| 2554414 | 8/1977 | Fed. Rep. of Germany . |
| 2653788 | 9/1977 | Fed. Rep. of Germany . |
| 2749147 | 5/1978 | Fed. Rep. of Germany . |

*Primary Examiner*—John Parrish

*Attorney, Agent, or Firm*—Whittemore, Hulbert & Belknap

[57] ABSTRACT

This provides a way of producing a sand mould which does not require heavy mechanical presses or violent vibration to ensure sand properly fills tight patterns in a mould. Sand is put into a buffer zone 40 via a feed device 2,3. Below the buffer zone 40 is a flask 10 and pattern plate 14, and the space between the buffer zone 40, the flask 10 and the plate 14 defines a charging chamber through which the sand must fall to produce the mould. This space, and preferably the buffer zone as well, is evacuated. This eliminates air resistance to the falling sand and, as a result, the sand fills the mould properly. The sand is allowed to fall after the vacuum has been established. The reason for evacuating the buffer zone is to bleed the sand of air. It is preferred that the pressure in the charging chamber is reduced further than that in the buffer zone, since a difference in pressure will further accelerate the sand towards the pattern plate.

9 Claims, 7 Drawing Figures

2
85
3
125
44
43
41
81
1
45
82
128
42
55
56
40
47
46
57
72
71
74
53
8
75
52
50
51
48
7
11
12
15
14
13
10
9
7
16
32
18
21
19
20
28
27
29
22
31
24
6
6
25
30
23
26
6a
5a
5
4
5
4

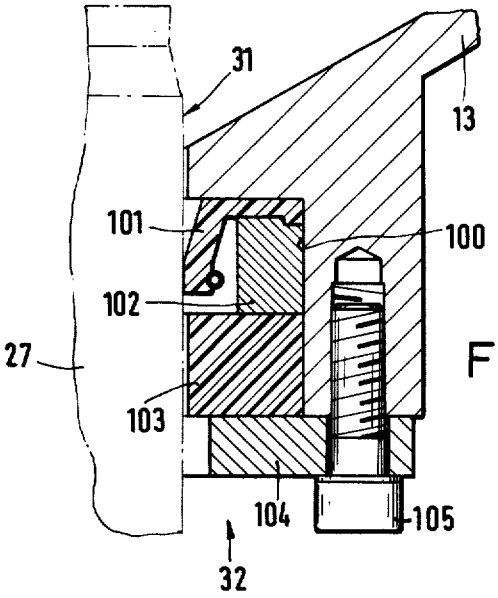
Fig.5
Fig.6
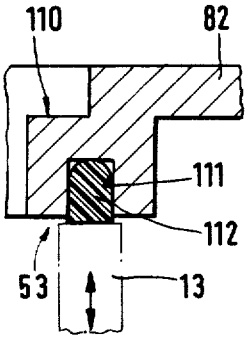
Fig.7
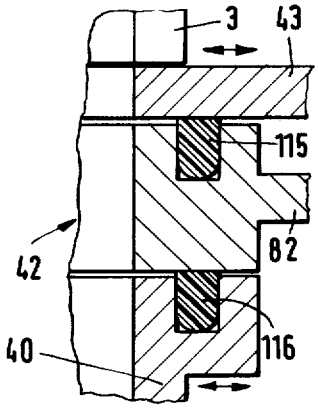

PRODUCTION OF SAND MOULDS

The invention relates to a method and to apparatus for the production of sand moulds or the like, in which a moulding compound is charged and compacted over a pattern into a flask while the pressure in the charging chamber is reduced below atmospheric pressure.

Numerous different moulding machines have been disclosed for the production of casting moulds, more particularly sand casting moulds. In these machines the moulding compound is compacted over the pattern, disposed in the flask, either by vibration or shaking or preferably by mechanical press devices. Also the moulding compound may be injected into a charging chamber above the pattern by a positive pressure and to simultaneously compact the compound.

The vibratory method is progressively disappearing from practical operation owing to the noise nuisance associated with it. Mechanical compaction of moulding compound by means of press rams calls for separate steps which ensure uniform compaction of the moulding compound without blow holes, even over patterns which have a substantially profiled and complex surface. To this end the moulding compound which is charged over the pattern, can be subjected to negative pressure during the compacting operation (see German Offenlegungsschrift No. 2 554 414). Similar methods have also been adopted for the so-called injection process as indicated by this Offenlegungsschrift. Relatively and complicated and complex apparatus and patterns have been proposed: see also German Auslegeschrift No. 2 653 788 and German Offenlegungsschrift No. 2 749 127.

The essential feature of such methods is the removal of air from the charging chamber above the pattern and within the flask as far as possible so that the adverse effect of air contained in the moulding compound is substantially eliminated when the moulding compound is injected or the moulding compound is compacted by means of press rams.

When compaction is performed by means of press rams in accordance with the above-mentioned Offenlegungsschrift No. 2 554 414 this is achieved mainly by virtue of the press ram system as well as the pattern and the moulding sand being enclosed in a vacuum-tight chamber during the compacting operation, which said chamber is formed by the bottom ram, the flask, the charging frame and an extension member which elongates the charging frame in the upward direction beyond the press device to a top sealing wall. Results, which are substantially better than those obtained by mechanical compaction without bleeding, were obtained in this way. However, the system is relatively complex and more particularly it is trouble-prone because on the one hand the seals are provided on parts which are subject to a high degree of wear and on the other hand constant extraction through the ducts provided in the mould parts and patterns leads to extensive erosion effects in the extraction ducts. Furthermore, in the apparatus with press rams it is necessary for substantial compacting work to be applied in order to achieve the desired homogeneous compaction.

In the injection process, which operates by the production of negative pressure in the charging chamber, it has been found to be detrimental that the pressure in the charging chamber rises with the commencement of the injection process with the risk that air will again ingress into the moulding compound and cannot be completely discharged from the compound so that irregularities are formed on the sand mould surface or air bubbles are formed in the interior of the sand mould. This results in an increase of the reject rate in the production of castings.

We have now discovered a process and apparatus which can overcome these disadvantages and which can achieve a relatively high degree of homogeneous compaction of the compound above the pattern even without injection and without mechanical press ram compaction while ensuring that the mould surface is perfectly formed and the sand mould or the like is produced without air bubbles. At the same time the high degree of wear, more particularly on the seal surfaces and on the extraction ducts which occurred hitherto, can be avoided when performing the new method.

According to the invention the problem is solved in that a quantity of moulding compound, sufficient for forming one casting mould, is initially stored in a buffer zone, that the pressure in the buffer zone as well as in the charging space above the pattern is reduced substantially below atmospheric pressure and thereafter, while maintaining the vacuum, the moulding compound is transferred from the buffer zone into the charging chamber by utilizing gravitational force.

In the novel process the charging chamber in the flask above the pattern as well as a separate buffer zone, which can be hermetically sealed with respect to atmosphere, is evactuated prior to the charging chamber being filled with moulding compound and a quantity of moulding compound, sufficient for forming the mould, is disposed in the buffer zone.

The extraction of air removes the air which offers resistance to the free fall of moulding compound when this is charged over the entire dropping height between two buffer zones and the charging chamber. When the connection between the buffer zone and the charging chamber is then released, the moulding compound, which has been bled of air, will drop freely into the charging chamber without experiencing the conventional deceleration caused by air. Compared with known methods, the "dropping height" of the moulding compound into the charging chamber is effectively increased. Since the sand or some other moulding compound has already been largely purged of air before the moulding compound is charged into the charging chamber it is possible for the connection between the zones and spaces subject to vacuum on the one hand and the device for producing the vacuum on the other hand to be interrupted during the charging operation without any change of the vacuum during the charging operation. The need for constant evacuation and the associated high degree of corrosion or erosion of the seals and ducts is thus avoided. Substantially more uniform sand charging and substantially greater compaction of the charged sand over the pattern solely under the action of gravitational force is achieved since the sand has already been bled of air and drops into the charging chamber over a quasi increased height. The absence of air results in substantially sharper forming, even of fine or difficult pattern contours, even when compared to the known vibratory processes. The compaction achieved in this manner is frequently completely adequate for moulding compounds containing hardening or hardenable binders, more particularly resin binders, so that no compaction is necessary either by injecting the sand or by means of a press ram device. Additional compacting steps may be used for conventional moulding sands, for example those containing bentonite.

As already described, this method makes it possible to purge the sand substantially of all air before the sand is charged into the charging chamber, and it permits acceleration of the sand beyond that due to gravity. This is achieved by subjecting and maintaining during charging the buffer zone and the charging chamber at a pressure less than one atmosphere and by keeping the pressure in the charging chamber below that of the buffer zone. A precisely controllable pressure difference can be utilized for the additional acceleration of the sand during the charging operation without substantially influencing the vacuum in the charging chamber.

Furthermore, the buffer zone can be optionally and hermetically sealed with respect to the feeding device by means of a movable or flexible wall, the outside of which can be biased by atmospheric pressure at the beginning of the charging operation.

It is advantageous to provide a press ram system within the region which is hermetically sealed with respect to the atmosphere. This ram device can be brought into action for final compaction of the charging compound after charging and precompaction.

The invention can be carried out using apparatus comprising means for the introduction of a suitable quantity of moulding compound into a charging chamber defined by a flask and a pattern, a device for the airtight closure of the charging chamber and which can be connected to the feeder by means of an operable closure, and means for generating in the charging chamber a pressure which is substantially below atmospheric pressure.

A storage chamber may be provided for receiving a quantity of moulding compound sufficient for one moulding operation. This may be positioned beneath the feeding device and above a compaction chamber for receiving the flask. The storage chamber can be charged via the feeding device and, for the purpose of charging by means with which the charging chamber can be connected to the compaction chamber and is constructed as a pressure lock and by means with which the compaction chamber as well as the storage chamber can be connected to the device for generating the defined vacuum. In this arrangement there is the important advantage that all sealing surfaces required for hermetic sealing are provided in the interior of the device, and not on components which participate directly in the production of the sand mould. Accordingly, these seals can be substantially better protected against wear and therefore ensure a much better hermetic seal with respect to the external atmosphere. The charging chamber is separated by the buffer chamber, constructed as a pressure lock, from the feed device, which communicates freely with the external atmosphere and is intended for the moulding compound. As already known for a pressure lock, the buffer chamber can be alternately connected to the feed device for supplying the desired quantity of moulding compound or it can be connected to the compacting chamber for transferring the moulding compound to the charging chamber.

To this end it has been found particularly advantageous if an operable closure is provided between the buffer chamber and the compaction chamber, which said closure is permeable to air but not to the moulding compound when the closure is in its closed or locked position. In this way the buffer chamber is flow-connected to the compaction chamber in a very simple manner in order to generate the vacuum so that it is merely necessary for one of the chambers, preferably the compacting chamber, to be connected to apparatus for generating the vacuum. The flow resistance offered by the closure and/or by the moulding compound disposed thereabove to the discharging air can in the preferred arrangement advantageously be utilized during the generation of vacuum in the buffer chamber and in the compacting chamber to result in a slightly lower reduction of pressure in the headroom of the compacting chamber above the quantity of moulding compound so that a desired and defined pressure difference is produced between the two chambers to accelerate the moulding compound while it is transferred from the buffer chamber into the charging chamber.

Conventional patterns and flasks which do not call for any steps requiring the extraction of air can be used in conjunction with the novel device, because they may both be completely enclosed in the compacting chamber which can be connected in its entirety to the means for generating the vacuum. Gas generation, which can also occur with the injection method and occurs normally, is very effectively counteracted since the moulding sand is hermetically sealed from the external atmosphere during the charging operation.

If mechanical press ram compacting means are required it is convenient to construct the buffer chamber so that this together with the press ram device or a compacting abutment head can be slidably accommodated in a common vacuum chamber to enable them to be optionally brought into alignment with the charging chamber without thereby impairing the vacuum in the buffer chamber or in the compacting chamber.

Final compaction can also be achieved by thrusting the pattern in the flask against the moulding sand charged therein. Conveniently, however, compaction is obtained by means of a multipunch presshead which acts on the top of the moulding sand which is charged into the chamber. The vacuum is maintained during mechanical finish compacting in both cases.

One embodiment of the invention will be explained hereinbelow by reference to diagrammatic drawings in which:

FIG. 5 is an enlarged cross-section of the hermetic seal in the region beneath the pattern.

FIG. 6 shows in a view similar to that of FIG. 5 means for sealing the region above the pattern and FIG. 7 shows in similar view means for sealing the slide region.

Figure 1:
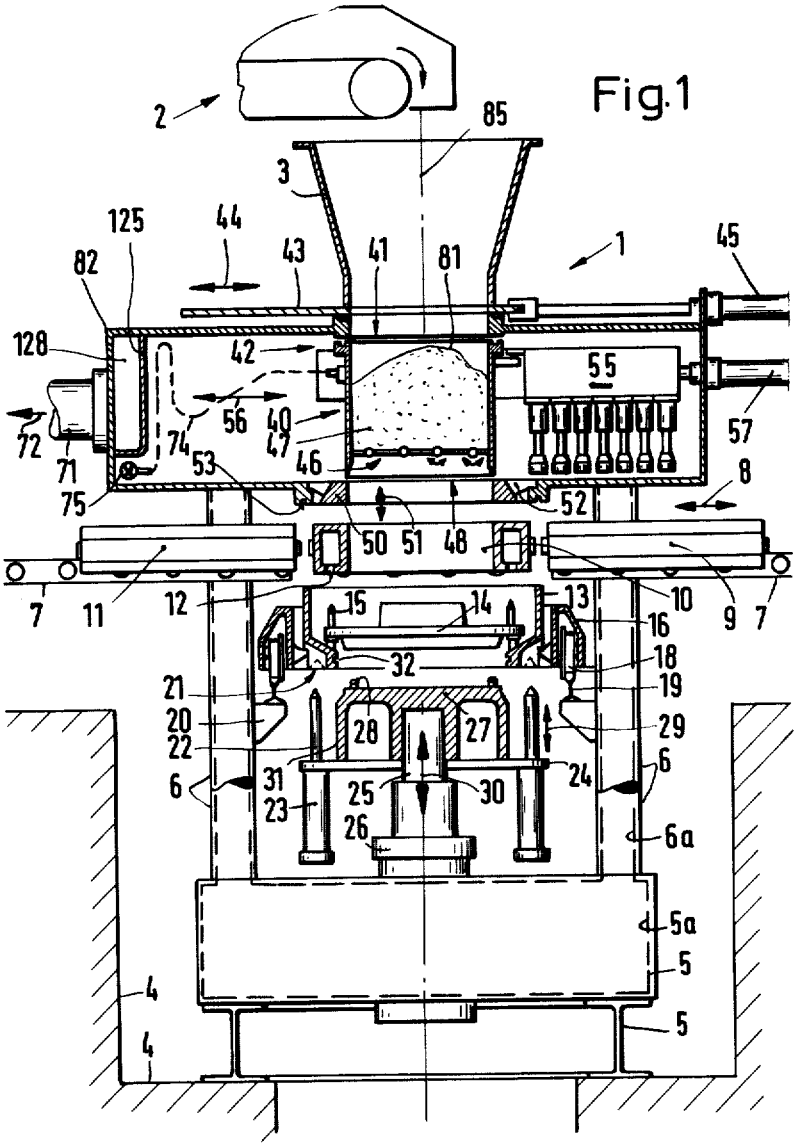
FIG. 1 is a vertical section through a preferred machine suitable for performing the novel method.
Figure 2:
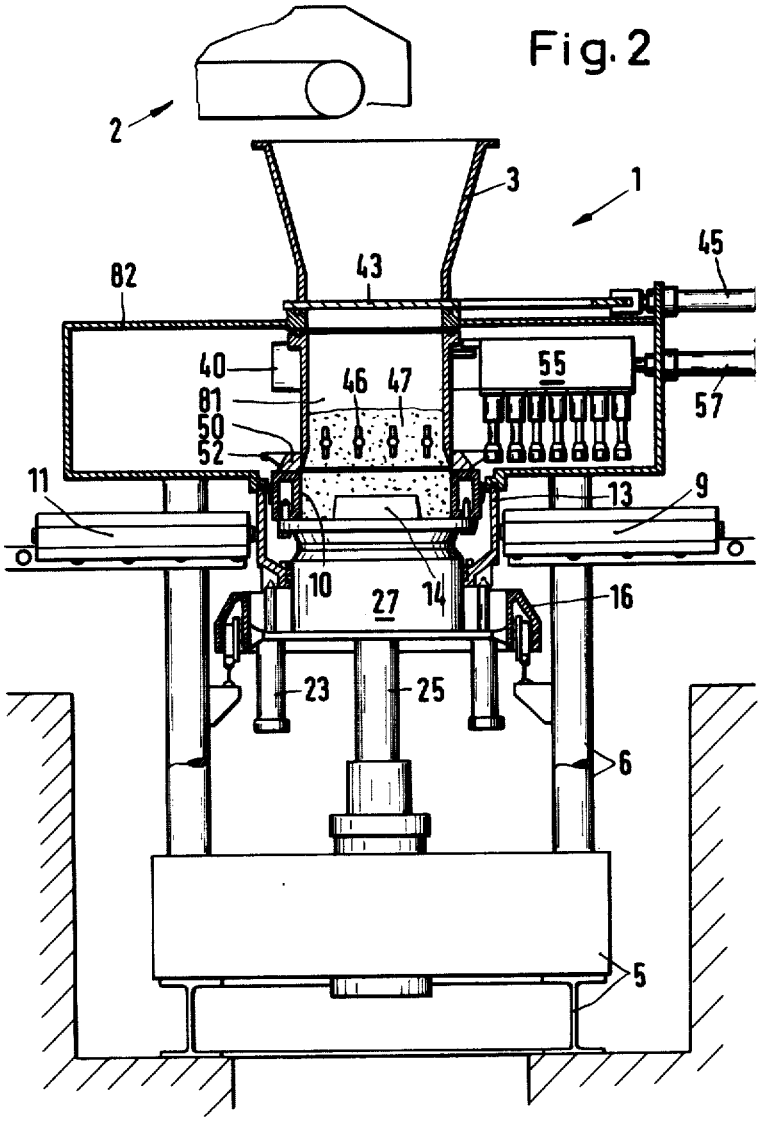
FIGS. 2 and 3 show a machine similar to that of FIG. 1, but in different operating phases compared with the open or inoperative position of the machine shown in FIG. 1.
Figure 3:
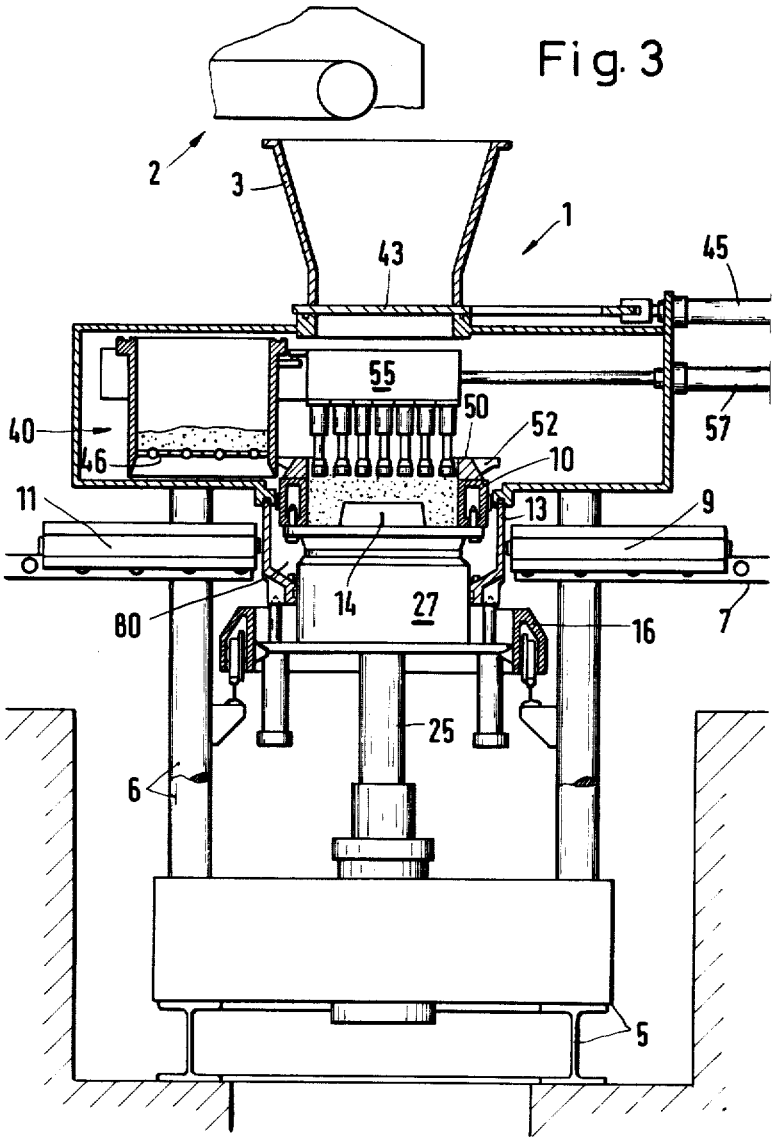

In FIGS. 1 to 3 a machine 1 has a feeder conveyor 2 for charging moulding compound into a hopper 3. On its exit side 41 the hopper 3 is provided with a hermetically sealable closure, for example in the form of a slide closure 43 which can be slid by an actuating device 45 from an open position shown in FIG. 1 to a closed position shown in FIG. 2, as indicated by the double arrow 44. The slide closure co-operates with corresponding seals 43a when in the closed position, as shown in FIG. 2.

A machine bed 5 mounted on a foundation 4 supports the other fixed components of the machine above the base 5 by means of pillars 6.

A conveyor, oriented parallel with the plane of the drawing in FIG. 1, extends between the columns through the machine and enables empty flasks 9 to be supplied in the directions of the arrow 8 into the operating position of the flask 9, and enables flasks 11, already filled with sand moulds, to be discharged to the left in FIG. 1.

On the underside flasks 9 to 11 may be provided centring openings 12 which can co-operate centring pins 15 on a pattern 14 or on the pattern carrier 13 if the flask is placed on the pattern in accordance with FIGS. 2 and 3.

The pattern 14 is interchangeably disposed on the centring pins 15 or the pattern holder 13. The pattern holder is constructed as an annular casing portion, which, in the FIGS. 1, 2 and 3, can be driven out of the machine in a direction perpendicular to the plane of the drawing. The outward driving motion can be utilized for exchanging the pattern or preferably for the alternate production of casting moulds in top and bottom flasks. In this case the casing member 13 with the pattern 14 can be driven out of or retracted into the machine alternately against a like component. To do this the casing 13 is loosely supported on inwardly extending support fingers 17 which are provided on the inside of a support frame 16 containing rollers 18, by means of which the support frame can traverse on rails 19 in a direction perpendicular to the plane of FIGS. 1, 2 and 3. The rails are supported by the pillars 6 on brackets 20. Centring recesses 21 are provided on the underside of casing 13 into which centring bars 22 can engage from below. The centring bars are retained in cylinders 23 so as to be slidable parallel to the double arrow 29. The system can be arranged so that the centring bars 22 are resiliently prestressed in the upwardly extended position but on exceeding a particular force can be urged back against the prestress in the cylinders 23. The centring bars 22 can also be positively extended and retracted by control of the cylinders 23, should this be desirable.

The cylinders 23 are mounted on a table 24 which supports a piston-like bottom closing member 27. The table 24 is mounted at the end of a piston rod 25 which can traverse vertically in the directions of the double arrow 30 in the base 5 of the machine by the operation of a cylinder 26.

The external contour 31 of the bottom closing member 27 fits exactly the contour and size of the internal bottom aperture of the casing member 13. A sliding seal 32 is disposed in the circumference of the bottom aperture and can accommodate the contour 31 of the bottom closing member with hermetic sealing.

The top of the bottom closing member 27 is provided with driver struts 28 which mate with corresponding openings on the underside of the pattern 14.

The casing 13 is constructed so that, when the piston rod 25 is extended and the centring bars 22 are entrained, the top part of the casing extends in telescoping manner with radial clearance over the outside of the flask 10 which is in its operating position and the casing 13 can be lifted off its supporting device 16. The casing 13 can be raised so that its top edge disposed far outside the region of the filling zone for the moulding compound acts sealingly on the ring seal 52 of a top casing member 82 which is fixed with respect to the frame.

The top casing member 82, which is fixed with respect to the frame, is constructed to withstand a vacuum and is supported by the pillars 6. The casing member in turn supports the filling hopper 3 and its closure 43. In the illustrated example the seal 43 surrounds a central recess in the casing member or vacuum chamber 82, from the edge of which there extend support fingers 52 on which a charging frame 50 bears in the illustrated inoperative position shown in FIG. 1. The plane 48 of a port of the intermediate buffer 40, disposed in the vacuum chamber 82 so as to be slidable in accordance with the arrow 56 in the illustrated example is situated above the top boundary plane of the charging frame 50 in accordance with the position shown in FIG. 1. The buffer 40 is provided with a bottom edge in the manner of a cutting edge to form the exit port 48 and above the said exit port 48 it is provided with an operable closure 46. In the illustrated example the closure is constructed as a louvred closure 46, and a known type may be used. Advantageously, the closing elements of the louvred closure are so arranged and constructed as to form a lock for the moulding compound 47 when they are in the closed position shown in FIG. 1, but are nevertheless freely permeable to air. The louvre elements 46 can therefore be constructed in the manner of perforated screen. A storge chamber 81 is defined above the louvred closure and can be hermetically sealed with respect to the feeder device 2, 3 by means of the slide 43 as shown in FIGS. 2 and 3. To ensure slidability of the buffer 40, (FIGS. 1 and 3) it can be convenient to arrange a seal 42 at the top of the buffer which can connect or be adapted to connect the buffer with a varying sealing effect to the part of the hopper disposed beneath the slide 43, in the position indicated in FIGS. 1 and 2.

The buffer 40 provides intermediate storage of a quantity of sand or moulding compound sufficient for the production of one mould, and it also functions as a pressure lock for the machine, as will be explained below. It will be seen that by comparing the volume of the buffer 40 with the quantity of moulding compound, that a headroom 81 free of moulding compound can remain above the sand mass.

In the illustrated example it is assumed that the sand mass, charged into the charging chamber, may require final mechanical compaction by a press device. To this end a multiram presshead 55 may be provided as illustrated in a preferred example shown in FIGS. 1 to 3. This head can be slid from the inoperative position shown in FIG. 1 to an operative position shown in FIG. 3, by means of a sliding device 57 in the direction of the arrow 56. Conveniently the buffer 40 and the multiram presshead 55 are constructed as a slidable unit which is disposed in its entirety in the vacuum chamber 82. This arrangement means that the buffer 40 and the presshead 55 can ne brought alternately into alignment with the charging chamber.

The system is connected to a vacuum source followed by a vacuum tank of large volume. A controllable valve can be provided in the connection between the two. The vacuum may be generated by any suitable simple manner.

Figure 4:
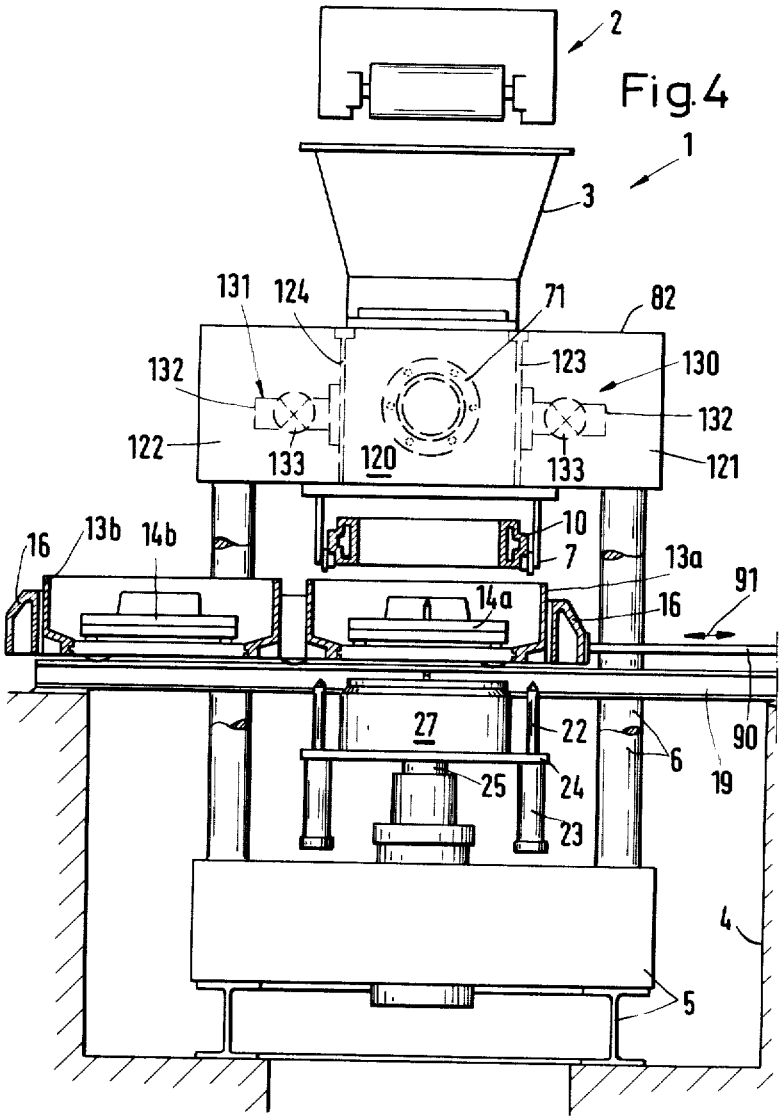
FIG. 4 is a view of the machine shown in FIG. 1, but partially sectioned and viewed in the direction of the flask supply conveyor.

As indicated by broken lines in FIG. 1, the box-shaped base 5 of the machine may be constructed as a hollow box designated 5a. Correspondingly, one, and more particularly all pillars 6 are also constructed as hollow pillars, the bottom ends of which are in free flow communication with the box-shaped base 5. At their top ends the hollow pillars extend into the top box or vacuum chamber 82. As can be seen by reference to FIG. 1 in conjunction with FIG. 4, the top box 82 may also be constructed as a top support element, in accordance with the bottom box-shaped base 5. If the apparatus is viewed in the direction of the guideway 7, as illustrated in FIG. 4, one can see that the interior of the box 82 is divided into three main chambers 120, 121 and 122 by means of bulkheads 123 and 124. In the illustrated example the middle chamber 120 terminates at the endface in a transverse wall which interconnects the walls 124 and 123. The middle chamber part 120 can be hermetically closed by means of seals situated at 42. The unit comprising the buffer 40 and the press ram head 55 slides in the above-mentioned part of the chamber, as indicated in FIG. 1.

The two lateral chambers 121 and 122 are hermetically sealed with respect to the exterior and with respect to the middle chamber 120 and communicate with each other in free-flow connection by means of the chamber 128 which is disposed in front of the end wall 125. At this end of the box 82 there is provided the connecting socket 71 which, as indicated by the arrow 72, can communicate constantly with a source of vacuum not shown. The hollow pillars 6 also extend into the chambers 121 and 122 so that the chambers, the connecting chamber 128, the hollow pillars 6 and the hollow box-shaped base component 5 define a large-volume vacuum tank which is integrated with a machine and can be in constant and open communication with the vacuum source thus ensuring that the machine is supplied with a constant vacuum which rapidly comes into operation.

A connection between the vacuum vessel formed by the above-mentioned components and the middle chamber 120 of the top vacuum box 82, is provided in one or both bulkheads 123 and 124, more particularly in the chambers 121 or 122. Two such connections 130 or 131, which can be controlled from the outside, are provided in the illustrated example. Each connection is provided with a socket 132 which extends in the open state into the associated chamber 121 or 122 and each such connection is provided with a valve 133 which can be controlled from the outside. Conventional such valve controls and other machine control means may be used, and they will not therefore be described and explained here. When the valves 133 are opened the middle chamber 120 will be in open flow communication with the vacuum vessel. A corresponding vacuum will therefore be produced in the chamber 120 which passes by the changing frame 50 or the raised flask 10 (see FIG. 2) and instantly provides the required vacuum in the compacting chamber 80 (see FIG. 3) and therefore also in the empty flask 10.

Advantageously a vacuum is produced in the buffer 40 via an air-permeable closure 46 and the moulding compound 47.

As indicated in FIG. 1 a bypass 74, preferably a flexible vacuum hose, can extend additionally from the intermediate chamber 128 through the middle chamber 120 into the buffer 40, namely in the head chamber 81 thereof. Advantageously this connection is provided with a restrictor 75, which can be adjusted from the outside, so that the magnitude of the vacuum in the head chamber 81 can be accurately controlled.

Various seals 31, 32 or 53 or 42, generally essential for hermetic sealing, are shown in detail in FIGS. 5 to 7.

FIG. 5 shows the seal at 32 between the piston-like bottom closure member 27 and the bottom aperture of the casing member 13. FIG. 5 shows to an enlarged scale only portions of both components in the sealing region. The casing member 13 is provided with a circumferential recess 100 in which a lip seal 101, a spacer collar 102, a further seal element 103 are disposed successively to bear against a shoulder. The components are preferably clamped in place by a stressing collar 104 by means of the screw 105. The lip seal 101 and the ring seal 103 co-operate with the correspondingly machined surface 31 of the bottom closure member 27 to form a hermetic seal and it can be seen that the lip seal 101 can be associated with a known prestressing element to increase the prestress in the lip.

The seal 53 between the top vacuum box 82 and the top end edge of the casing member 13 is shown in FIG. 6. The top end of the rise and fall casing member 13 is indicated by dash-dot lines. A groove 111, open at the bottom, into which a ring seal 112 is inserted, is worked into the aperture which accommodates the charging frame 50 on the underside of the vacuum box 32. The top end of the casing 13 co-operates under pressure with the ring seal. The seal region 53 is situated at a substantial distance from the regions which will be subjected to sand or other moulding material since the seal and the top end of the casing 13 have a large diameter compared with the internal diameter of the flask 10, and more particularly since the flasks are preferably charged when the components are closed and this prevents dust and sand entering the sealing region 53.

FIG. 6 also shows the shoulder 110 on which the fingers 52 of the charging frame 50 bear in the bottom position shown in FIG. 1. The system is preferably arranged so that the vacuum can act without obstruction between the compacting chamber 80 and the vacuum box 82 in every position of this region.

A portion of the seal 42 in the region of the slide 43 is shown in FIG. 7. The bottom end of the hopper 3 can be recognized—the hopper has a slit in which the slide 43 is slidably guided. The vacuum preferably opens so powerful and rapidly that in its closed position the slide 43 is firmly ruged against the seal 115 by the external atmospheric pressure so that hermetic closure is obtained at this place even if the seal is contaminated.

The bottom side of the flange associated with the casing portion 82 is smoothly machined. A ring seal 116, inserted into a groove, open at the top, of the buffer 40, co-operates with the said smooth surface so that the said buffer can be slid in the illustrated furnace. The seal should be so designed that hermetic sealing is ensured, at least in the position of the buffer illustrated in FIGS. 1 and 2. This is desirable because in this position, despite the vacuum in the head chamber 81 of the hermetically sealed buffer and compaction chamber 80, there is preferably a different degree of vacuum in the buffer and in the compaction chamber. As mentioned above, the vacuum in the head chamber 81 should be slightly lower than in the compacting chamber 80. This difference of vacuum is no longer required in stage shown in FIG. 3 so that in this position, or at the beginning of the motion of the buffer from the position according to FIG. 2 into the position according to FIG. 3, it is no longer necessary for the seal to act along the seal strip 116. Obviously, the full vacuum is also obtained in the position according to FIG. 3 since the entire middle chamber 120 is maintained at the defined vacuum during the operating phases of the machine.

A method of operation of a machine such as that illustrated is as follows.

FIG. 1 shows a machine in the starting or open position. It is assumed that the full flask 11 has left the machine while the empty flask 10 has been inserted into the machine and the flask 9 will later replace flask 10.

Flask 11 may be a top flask, and in a preferred method of operation the flask 10 will then function as bottom flask so that top flasks and bottom flasks may be alternately mounted. To do this the holder 16 may be reciprocated between two positions in accordance with the double arrow 91 shown in FIG. 4, transversely to the track 7 of the flask, by, for example, a thrust device of which only a piston 90 is shown. The holder 16 is provided for supporting two identically constructed casing members 13*a*, 13*b*, of which the casing 13*b* contains a pattern 14*a*, say, for the bottom flask and the casing member 13*b* contains a pattern 14*b* for the top flask. Each of the casing parts 13*a* and 13*b* can be raised and lowered independently, with respect to the holder which can traverse on the rails 19.

In FIG. 1 it can be seen that the desired quantity of sand 47 has been charged into the buffer 40. The slide 43 is open, and a full vacuum is applied to the chambers 121, 122 and 128 as well as to the box-shaped base member 5. However, these parts are hermetically sealed with respect to the middle chamber 20 since the valves 133 are closed. The middle chamber 120 as well as the compacting chamber 80 and the buffer 40 will be under atmospheric pressure.

The piston rod 25 is then extended and the bottom closure member 27 is retracted into the bottom aperture of the casing 13 under conditions of hermetic sealing at 32. The studs 28 will then bear upon the underside of the pattern 14 while the centring bars 22 engage in the centring apertures 21 of the casing 13. The casing part 13 is entrained as the bottom closure member 27 continues to move. In the course of this, the centring pins 15 engage with the centring apertures 12 of the bottom flask 10, eventually entrain the latter, and the casing part 13 fully surrounds the bottom flask. Thereafter the top edge of the casing 13 bears against and seals with the underside 53 of the vacuum box 82. The required sealing pressure is maintained by the centring bars 22 which yield to pressure. The bottom closure member 27 can, however, continue to rise, and the flask also raises the charging frame 50 which extends telescopically over the bottom end of the buffer 40. The system will then be in a first intermediate position in which the compacting chamber 80 is hermetically sealed with respect to the exterior at places 31, 32, 53 and also at 42 when the slide 43 is closed. The valves 133 are then opened so that the vacuum in the chambers 121, 122 can act in the middle chamber 120 of the vacuum box 32. Also, the said vacuum can also act in the compacting chamber 80 via the gap surrounding the flask 10 in its top position. The compacting chamber and all chambers enclosed by it are evacuated with exceptional rapidity. Air is also extracted from the buffer 40 and from the sand enclosed therein through the air-permeable closure 46. The sand mass offers a resistance to the extraction of air, and as a result the vacuum in the head chamber 81 is formed more slowly than in the chamber regions beneath the closure 46. The closure 46 is suddenly opened, as shown in FIG. 2, once the desired vacuum is established in the compacting chamber 80 and sufficient vacuum for adequate bleeding of the sand mass 47 has been established in the head chamber 81 of the buffer 40. The sand, bled of air, drops rapidly into the charging chamber of the bottom flask 10 since no air resistance counteracts the downward movement of the sand under the action of gravity. Means can be provided to ensure that the closure 46 is opened at a time at which the vacuum in the head chamber 81 of the buffer 40 has not yet reached the full vacuum of the compacting chamber 80, thus producing a pressure difference which additionally accelerates the sand in the downward direction. The sand can fill with the greatest accuracy and sharpness all detailed shapes, even in difficult pattern surfaces since there is no air in the flask above the pattern. Furthermore, a very high density is obtained for the sand or other moulding compound charged into the flask in this way, either solely by gravity or, where appropriate, by gravity plus pressure difference.

Filling of the mould completes the second phase of the operating cycle (FIG. 2).

Next, the piston rod 25 is lowered until the charging frame 50 reaches the position according to FIG. 1 without however the hermetic seal at places 31, 32, 42 and 53 being broken. Thereafter, by operation of the slide cylinder 57, the buffer 40 together with the press ram head is moved from the position shown in FIG. 2 into that shown in FIG. 3. Hermetic sealing of the middle chamber 120 is obtained by means of the slide 43 which is in the closed position in FIG. 2. A full vacuum is therefore maintained in all chambers. Subsequently, the ram 25 is slightly raised until the charging frame behind the buffer 40 reaches the position shown in FIG. 3. The press ram head, in the illustration constructed as a multiram head, is taken into operation in order to effect final consolidation of the sand mass over the pattern. This is not necessary in all cases—compaction by vacuum filling alone of the air-bled sand is frequently sufficient.

Advantageously, the system is arranged so that after charging and compacting and any further treatment, such as hardening of the moulding compound over the pattern, the flask can be supported on the casing 13 by locking element (not shown) in a position above the flask track 7. If the piston rod 25 is then lowered the bottom closure member 27 with the pattern 14 can be lowered to the extent that the completed sand mould is released from the pattern while maintaining the vacuum, i.e. by retaining the position of the casing 13 in the position shown in FIG. 3. Mould stripping is substantially facilitated since this operation is performed in vacuo, and an additional vacuum can be produced even in deep regions of the pattern which hitherto readily caused parts of the sand mould to be torn off during mould stripping. As the lowering motion continues the seal is interrupted at 42 and the entire system is ventilated after the valves 133 are previously closed. Further downward motion of the piston rod 25 finally causes the flask 10 and casing 13 to be lowered and to be taken up by the flask 57 while the casing 13 and the bottom closure member 27 assume the starting positions illustrated in FIG. 1. In this position the casing 13 can be interchanged, as shown in FIG. 4, to move the pattern for the top flask plus associated casing 13*b* to the operating position within the machine. Direct air bleeding of the head chamber 81 and therefore additional air bleeding of the sand compound 47 can be achieved via the bypass 74 and adjustable restrictor 75 if air bleeding of the moulding compound 47 is obstructed by the bottom closure 46 to the extent that the operating cycle time of the machine would be unduly prolonged. This procedure also enables the precise pressure value to be adjusted in the head chamber 81.

The slide 43 can be adjusted so that when it is in its closed position it holds in readiness bellows or a diaphragm rather than a rigid closure member over the buffer 40. The bellows or diaphragm bear under the action of the external atmosphere and with an increasing vacuum on the sand compound in the buffer, and on the closure 46 being opened slow the sand compound through the closure apertures into the charging chamber of the flask. In this way it is possible to utilize the atmospheric pressure for the charging and consolidating process without impairing reliable air bleeding of the sand in the buffer 40.

I claim:

1. An apparatus for producing a mould, comprising means for putting a moulding compound in a buffer zone, means for reducing the pressure in the buffer zone and in a charging chamber over a pattern below atmospheric pressure, and means for transferring the moulding compound from the buffer zone into the charging chamber under gravity while maintaining the vacuum or partial vacuum produced on reducing pressure in the buffer zone and charging chamber below atmospheric pressure.

2. An apparatus for producing a sand casting mold or the like comprising an intermediate storage room for receiving an amount of molding compound sufficient to shape a casting mold, a charging chamber defined by a pattern, pattern support and molding box, a means for air-tight closure of the charging chamber, a device for producing a pressure substantially below atmospheric pressure within the charging chamber and an operable closure for connecting the intermediate storage room with the charging chamber to feed the molding material to the charging chamber, wherein the intermediate storage room is in the form of a pressure lock and on its charging side is provided with an air-tight closure, and that both the compacting chamber receiving the conventionally constructed molding box and the intermediate storage room, via connecting means, are connectible to the device for generating a pressure which is substantially reduced with respect to the atmospheric pressure, both when the closure is closed and when it is open.

3. An apparatus as claimed in claim 2, wherein the device for generating a vacuum can be connected with the compacting chamber receiving the molding box and that the operable closure, especially a plate or louvered closure, arranged between the compacting chamber and the storage chamber of the intermediate storage room is impermeable to the molding material, but permeable to air.

4. An apparatus as claimed in claim 2, wherein the connecting means is provided with a bypass between the device for generating the vacuum and the head chamber of the charging room of the intermediate storage room, said bypass having an adjustable throttle for varying the passage cross-section.

5. An apparatus as claimed in claim 2, wherein a die press head and the intermediate storage room are arranged in a common housing portion constructed as a vacuum chamber and can be optionally and alternatively brought into position above the compacting chamber.

6. An apparatus as claimed in claim 2, wherein an annular pattern support for defining the compacting chamber and for receiving the pattern and the molding box can be raised with respect to the conveying track of the molding boxes to sealingly engage an annular seal on the housing portion receiving the intermediate storage room.

7. An apparatus as claimed in claim 6, wherein the annular pattern support together with the pattern in interchange with an identically constructed and disposed housing portion is horizontally movable into and out of alignment with the intermediate storage room.

8. An apparatus as claimed in claim 6, wherein into the lower open end of the pattern support with circumferential hermetic sealing by means of a sliding seal there can be telescopically inserted a rise and fall bottom closure which at the same time is provided with centering bars resiliently yielding to pressure for raising the pattern support.

9. An apparatus as claimed in claim 5, wherein on the housing portion a charging frame is telescopically slidably guided and retained relative to the lower end of the intermediate storage room.

* * * * *